US005359544A

United States Patent [19]

Suwahara

[11] Patent Number: 5,359,544

[45] Date of Patent: Oct. 25, 1994

[54] MONITOR FOR CONTINUOUS FEEDING OF COLLATED ARTICLES

[75] Inventor: Susumu Suwahara, Tokyo, Japan

[73] Assignee: Toppan Printing Co., Ltd., Tokyo, Japan

[21] Appl. No.: 749,453

[22] Filed: Aug. 26, 1991

[30] Foreign Application Priority Data

Nov. 26, 1990 [JP] Japan ..... 2-321412

[51] Int. Cl.[5] ..... G01B 5/02; G01B 7/02; G01B 21/02; G06F 15/46

[52] U.S. Cl. ..... 364/550; 364/469; 364/471; 364/478; 364/563

[58] Field of Search ..... 364/469, 473, 478, 550, 364/552, 568, 571.02, 471, 472, 563, 562, 571.04; 902/16, 15; 412/11, 13, 14; 355/311; 324/671; 209/534, 546, 559; 271/3, 3.1, 9, 18.2

[56] References Cited

U.S. PATENT DOCUMENTS

| | | | |
|---|---|---|---|
| 4,154,437 | 5/1979 | Butcheck et al. | 902/16 X |
| 4,462,587 | 7/1984 | Graef et al. | 902/16 X |
| 4,504,916 | 3/1985 | Oka | 364/562 X |
| 4,545,031 | 10/1985 | Kobayashi | 364/471 X |
| 4,707,843 | 11/1987 | McDonald et al. | 902/15 X |
| 4,939,676 | 7/1990 | Worsley et al. | 364/562 |
| 4,953,841 | 9/1990 | Polarek | 270/58 |
| 4,996,658 | 2/1991 | Baker | 364/563 X |
| 5,245,547 | 9/1993 | Ramsey | 364/478 |

FOREIGN PATENT DOCUMENTS

| | | |
|---|---|---|
| 0086097 | 8/1983 | European Pat. Off. . |
| 1050236 | 7/1966 | United Kingdom . |
| 1329457 | 12/1973 | United Kingdom . |

*Primary Examiner*—Jack B. Harvey
*Assistant Examiner*—Melanie Kemper
*Attorney, Agent, or Firm*—Armstrong, Westerman, Hattori, McLeland & Naughton

[57] ABSTRACT

The apparatus for monitoring continuous feeding of articles which belong to different classes having different ranges of a characteristic value, and which are provisionally collated according to a given order of the classes in cyclic manner. A detector is provided to sequentially detect articles during the course of the continuous feeding so as to sample a characteristic value $D_{mn}$ of each article, where m denotes a cycle number and n denotes an order of the article in an m-th cycle. A memory is provided to store a given n-th reference characteristic value D(n) and a corresponding allowance value $\Delta D_n$, which are specific to an n-th order of the class. An n-th test reference range is set in the form of $D(n) \pm \Delta D_n$. Judgement is carried out in the m-th cycle such as to test whether the sampled characteristic value $D_{mn}$ falls within the n-th test reference range $D(n) \pm \Delta D_n$ to thereby monitor occurrence of misfeeding.

8 Claims, 7 Drawing Sheets

FIG.5

| ORDER n / CYCLE m | A1 | A2 | A3 | --- Ak |
|---|---|---|---|---|
| 1 | D11 | D12 | D13 | --- D1k |
| 2 | D21 | D22 | D23 | --- D2k |
| 3 | D31 | D32 | D33 | --- D3k |
| 4 | D41 | D42 | D43 | --- D4k |
| 5 | D51 | D52 | D53 | --- D5k |
| ⋮ | ⋮ | ⋮ | ⋮ | --- ⋮ |
| j | Dj1 | Dj2 | Dj3 | Djk |

MONITOR FOR CONTINUOUS FEEDING OF COLLATED ARTICLES

BACKGROUND OF THE INVENTION

The present invention relates to a monitor for use in continuous feeding of collated articles. Such a monitor is utilized during the course of transporting or feeding of an article such as a metal plate, a printing sheet or a unit thereof to a separate spot of a working machine etc., for judging as to whether articles are correctly and regularly transported one by one or unit by unit.

Generally, it is necessary to detect the occurrence of double feeding during the course of continuous or successive feeding of printing sheet articles one by one or unit by unit. The conventional detecting method is such that each article is measureed in terms of thickness, weight or transmittance of the sheet and the measured value is compared with a given reference value. For example, in a monitor for detecting double feeding of a sheet to a printing machine, generally the doubling detection is based on the fact that double or multiple sheets have a smaller transmittance than a single sheet.

The transmittance of an article is measured by a photocell etc., and the measured value is compared with a given reference value indicative of a normal transmittance of a sheet in the regular feeding. When the measured value falls within a given allowance around the reference value, the judgement is made that the feeding is normally and regularly carried out. If otherwise, the judgement is made that there has occurred erroneous feeding or misfeeding such as doubling or missing of sheets.

However, some types of sheet feeders are used for a collating and bookbinding machine, or a calendar print processing machine. For example, this type of working machine is operated such that different kinds of sheets including a cover, intermediate leaves and photogravure leaves are sequentially fed and recollated in the same order to bind a book. In such a case, the thickness of the sheets varies cyclicly according to the given order in dependence on class or brand of the sheets during the course of continuous feeding of sheets to the working machine. However, the conventional monitor is set with a single reference value, and therefore it cannot monitor the continuous and variable feeding in which the thickness of sheets varies cyclicly according to a given order or sequence.

SUMMARY OF THE INVENTION

An object of the present invention is to effectively monitor the cyclic and orderly feeding of different classes of articles along one line so as to judge as to whether the articles are fed regularly and correctly one by one or unit by unit.

According to the present invention, the monitor apparatus is constructed for monitoring continuous feeding of articles which belong to different classes having different ranges of a characteristic value, and which are provisionally collated according to a given order of the classes in cyclic manner. A detector is provided to sequentially detect articles during the course of the continuous feeding so as to sample a characteristic value $D_{mn}$ of each article, where m denotes a cycle number and n denotes an order of the article in the m-th cycle. A memory is provided to store a given n-th reference characteristic value D(n) and a corresponding allowance value $\Delta D_n$, which are specific to the n-th order of the class. An n-th test reference range is set in the form of $D(n)\pm\Delta D_n$. Judgement is carried out in the m-th cycle such as to test whether the sampled characteristic value $D_{mn}$ falls whithin the n-th test reference range $D(n)\pm\Delta D_n$ to thereby monitor occurrence of misfeeding.

In a preferred form, the n-th reference characteristic value D(n) is given in the form of an n-th known standard characteristic value $D_n$ specific to the n-th class. Therefore, the n-th test reference range is set in the form of $D_n\pm\Delta D_n$. Alternatively, the n-th reference characteristic value D(n) is given in the form a previously sampled characteristic value $D_{(m-1)n}$ which has been detected in a preceding (m−1)-th cycle. Therefore, the n-th test reference range is set in the form of $D_{(m-1)n}\pm\Delta D_n$ for testing the currently sampled characteristic value $D_{mn}$.

In another preferred form, the monitor apparatus is inputted with a maximum limit value $D_{max}$ and a minimum limit value $D_{min}$, which are indicative of effective upper and lower limits of detection capacity specific to an individual detector provided in each monitor apparatus. The maximum test reference value $(D(n)+\Delta D_n)_{max}$ among all classes of the test reference values is compared with $D_{max}$ and the minimum test reference value $(D(n)-\Delta D_n)_{min}$ is compared with $D_{min}$. The original test reference range $D(n)\pm\Delta D_n$ may by limitatively adjusted, if necessary, according to the comparison results, thereby eliminating erroneous judgement of the sampled characteristic value of an individual article.

BRIEF DESCRIPTION OF THE DRAWINGS

FIG. 5 is a table diagram showing an example of sampled characteristic values;

DESCRIPTION OF EMBODIMENTS

Figure 1:
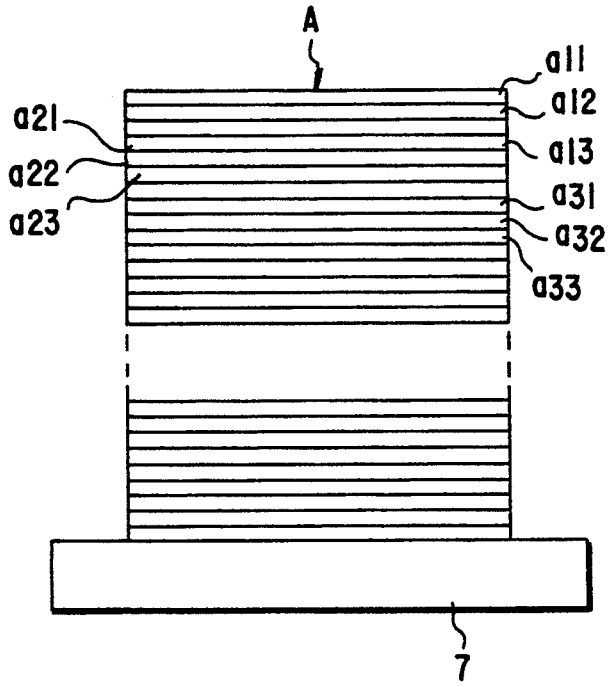
FIG. 1 is a side view of a stack of sheet articles which are to be continuously fed and monitored by the inventive monitor apparatus.

FIG. 1 shows a side view of a stack A of provisionally collated sheet articles which is to be treated in one embodiment of the present invention. For example, the stack A is comprised of three classes of sheets $A_1$, $A_2$ and $A_3$ having different standard thicknesses. The first class of sheet $A_1$ has a standard thickness of $D_1$, the second class of sheet $A_2$ has another standard thickness of $D_2$, and the third class of sheet $A_3$ has still another standard thickness of $D_3$. For example, $D_1$ is set to 0.1 mm, $D_2$ is set to 0.3 mm and $D_3$ is set to 0.5 mm. These three classes of sheets $A_1$, $A_2$ and $A_3$ are collated in this order to constitute a set. This set is repeatedly or cyclicly piled on a palette to form the stack A. As shown in the figure, individual sheet articles are labeled from top sequentially by $a_{11}$, $a_{12}$, $a_{13}$, $a_{21}$, $a_{22}$, $a_{23}$, $a_{31}$, $a_{32}$, $a_{33}$, . . . . In each label, the first suffix denotes a cycle number of a particular set counted from the top of the stack A, and the second suffix denotes an order number of an article in the particular set.

Figure 2:
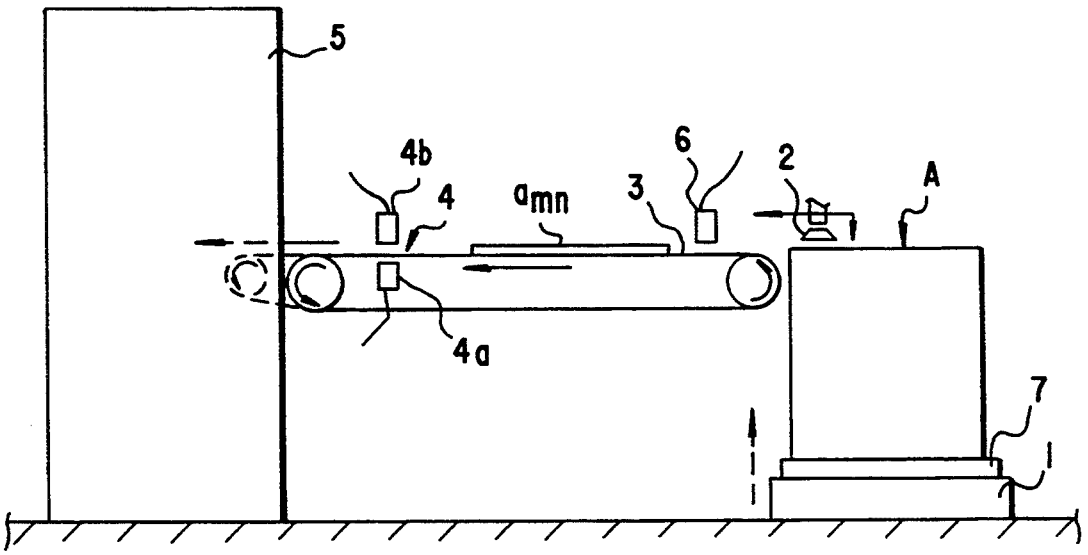
FIG. 2 is a side view of a feeder provided with the inventive monitor apparatus.

FIG. 2 is a side view including an article working machine for treating the provisionally prepared stack A of sheet articles shown in FIG. 1. The stack A is mounted on a table 1 of the working machine. A sucking device 2 is operated to successively transfer the sheet articles $a_{11}$, $a_{12}$, $a_{13}$, $a_{21}$, $a_{22}$, $a_{23}$, . . . , from the stack A to a feeder 3 composed of a belt conveyer so that the individual sheet articles $a_{mn}$ are continuously fed to a working unit 5. The working unit may be a printing and coating device, pressing device, binding device, cutting device or etching device. A photosensing detector 4 of the transmission type is provided in a path of the sheet articles $a_{mn}$ along the feeder. The detector 4 is comprised of projector **4*b* for projecting a light beam, and a photosensor 4*a* receptive of the light beam through the sheet article during the course of feeding to thereby effect detection or measurement of a thickness of each sheet article. This photosensing detector 4 may be replaced by a mechanical thickness gage. In addition, a counter 6** is provided to count articles.

Figure 3:
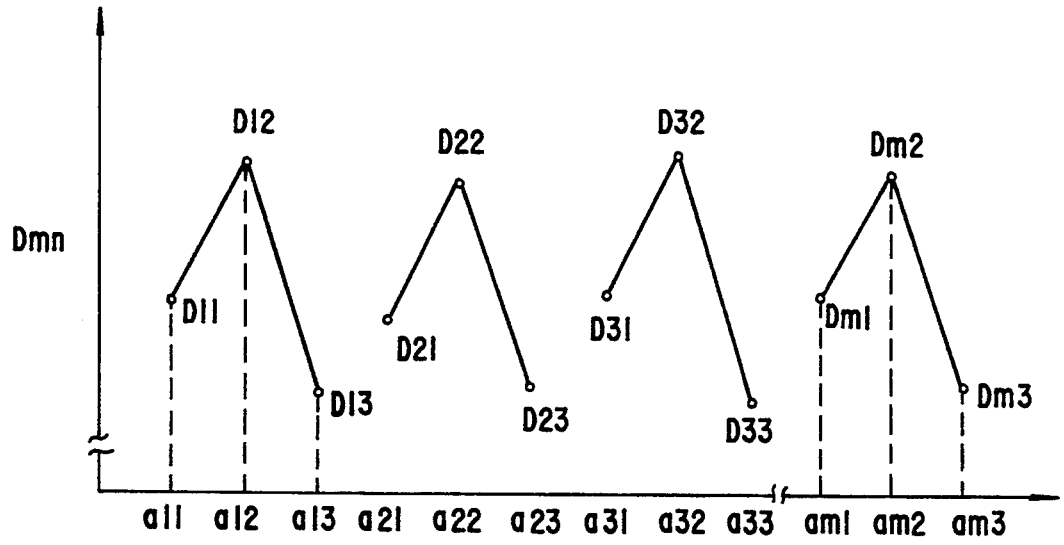
FIG. 3 is a graph showing an example of different sampled characteristic values of articles belonging to different classes.

FIG. 3 is a graph showing sampled characteristic value $D_{mn}$ of each sheet article $a_{mn}$ (where n=1, 2 or 3, and m denotes a cycle number) in the form of a thickness value measured successively by the detector 4.

The sampled characteristic data $D_{mn}$ measured by the photosensing detector or a thickness gage is plotted in terms of the vertical axis or Y axis, and the sequence of the measurement of the sheet article is plotted along the horizontal axis or X axis such as $a_{11}$, $a_{12}$, $a_{13}$, $a_{21}$, $a_{22}$, $a_{23}$, . . . .

Figure 4:
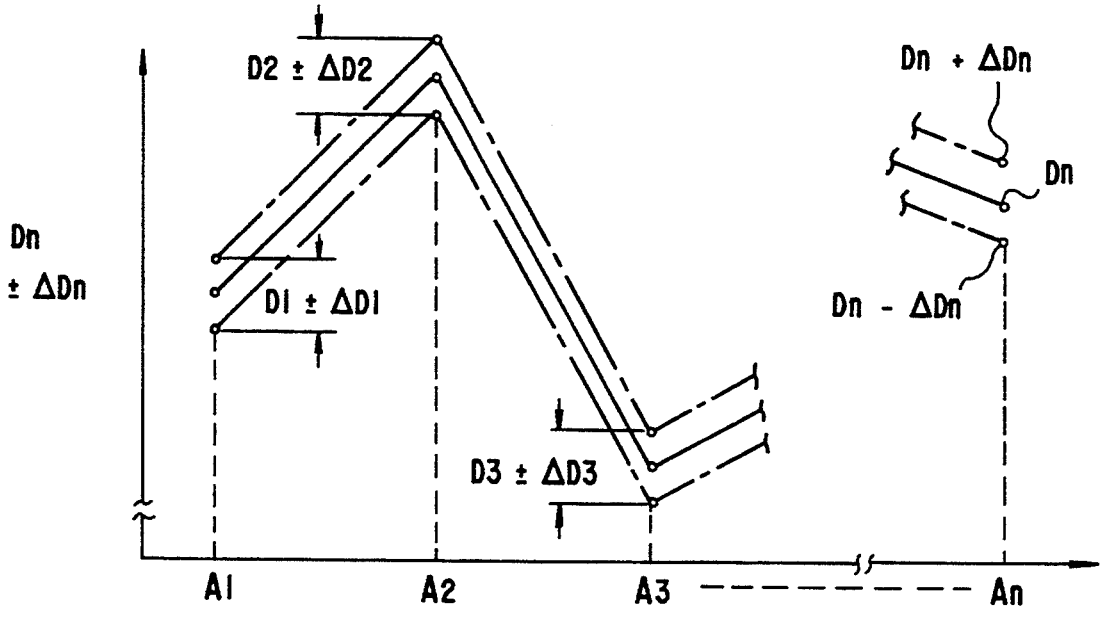
FIG. 4 is a graph showing an example of different test reference range data specific to different classes of articles.

FIG. 4 is a diagram showing definition of a test reference range $D_n \pm \Delta D_n$ with using a known standard characteristic value $D_n$ such as a typical thickness or weight of a particular class of sheet $A_n$ and an allowance $\pm \Delta D_n$. For example, this reference range $D_n \pm \Delta D_n$ may be initially set in the inventive monitor apparatus by manual operation. Different test reference ranges $D_1 \pm \Delta D_1$, $D_2 \pm \Delta D_2$, $D_3 \pm \Delta D_3$, . . . , $D_n \pm \Delta D_n$ are set to different classes of sheets $A_1$, $A_2$, $A_3$, . . . , An. The test reference range $D_n \pm \Delta D_n$ for the judgement is a sum of the standard characteristics value $D_n$ or a center value indicative of a standard quality of a particular class of the article such as a quality standard value according to JIS standard, and the allowance $\pm \Delta D_n$ which is determined according to an expected allowable variation of the quality of the particular class of article. The center value $D_n$ and the allowance $\pm \Delta D_n$ are provisionally inputted before the start of the continuous feeding of the article. In the FIG. 4 graph, the X axis denotes sheet classes $A_1$, $A_2$, $A_3$, . . . , $A_n$ cyclicly fed in this order, and the Y axis denotes corresponding test reference ranges $D_1 \pm \Delta D_1$, $D_2 \pm \Delta D_2$, $D_3 \pm D_3$, . . ., $D_n \pm \Delta D_n$ for use judgement as to whether each sampled characteristic value $D_{mn}$ of an individual article belonging to the sheet class $A_n$ is normal or abnormal. The sheet classes $A_1$, $A_2$, $A_3$, . . . , $A_n$ are plotted along the X axis in the order of cyclic feeding.

FIG. 5 is a table showing each sampled characteristic value $D_{mn}=D_{jk}(D_{11}, D_{12}, \ldots, D_{jk})$ of individual articles $a_{mn}$. The articles such as a print sheet, metal plate and small package are sorted into grades or classes $A_1$, $A_2$, $A_3$, . . . , $A_k$, and are cyclicly arranged in this order. At the j-th cycle, the set of k number of articles $a_{j1}$, $a_{j2}$. . . , $a_{jk}$ have the corresponding sampled characteristic values $D_{j1}$, $D_{j2}$. . . , $D_{jk}$.

In a modification of the inventive monitor apparatus, the test reference range is automatically set in the form of $D_{mn} \pm \Delta D_n$ where $D_{mn}$ is a sampled characteristic value detected in real time basis during the course of the article feeding and $\Delta D_n$ is a known allowance value. For example, the first set of the sampled characteristic values or sampled data $D_{11}$, $D_{12}$, $D_{13}$, . . . , $D_{1k}$ at the first cycle m=1 is stored in a memory means. Then, each of the stored data is automatically added with corresponding one of allowances $\pm \Delta D_1$, $\pm \Delta D_2$, $\pm \Delta D_3$, . . . , $\pm \Delta D_k$ which are provisionally determined to indicate allowable variation of the characteristic value in each article class, thereby calculating each of the test reference ranges $D_{11} \pm \Delta D_1$, $D_{12} \pm \Delta D_2$, $D_{13} \pm \Delta D_3$, . . . , $D_{1k} \pm \Delta D_k$. Thereafter, a next set of articles $a_{21}$, $a_{22}$, . . . , $a_{3k}$ is tested based on the thus calculated test reference ranges during the sheet feeding operation at the second cycle of m=2 so as to check whether abnormal feeding or misfeeding such as doubling occurs or not.

In another modification, the once calculated test reference range can be updated. Namely, the set of currently sampled characteristic values $D_{mn}$ in the form of thickness, weight or optical density at the m-th cycle is successively tested by the set of updated test reference ranges $D_{(m-1)n} \pm \Delta D_n$ which are calculated by adding the known specific allowance $\pm \Delta D_n$ of article class $A_n$ to the corresponding previous sampled characteristic value $D_{(m-1)n}$ at the (m−1)-th cycle. If the currently sampled characteristic value $D_{mn}$ falls within the test reference range $D_{(m-1)n} \pm \Delta D_n$, the article $a_{mn}$ is judged normal. On the other hand, if the sampled value $D_{mn}$ is out of the test reference range, the article $a_{mn}$ is judged abnormal.

The test reference range is given in the form of $D_{(m-1)n} \pm \Delta D_n$ for testing the sampled characteristic value $D_{mn}$, where m denotes a current cycle number and n denotes an order of article classes arranged in one cycle. Further, the test formula is given in the form of $D_{(m-1)n} - \Delta D_n < D_{mn} < D_{(m-1)n} + \Delta D_n$. If the sampled characteristic value $D_{mn}$ satisfies the above test formula, the article $a_{mn}$ fed at the n-th order in the m-th cycle is judged normal to thereby instantly issue a normality signal indicating that no misfeeding such as doubling has occurred. On the other hand, if the above test formula is not satisfied, the judgement is made that misfeeding occurred at that moment to thereby issue an abnormality signal effective to stop operation of the working machine or effective to display an alarm.

Figure 6:
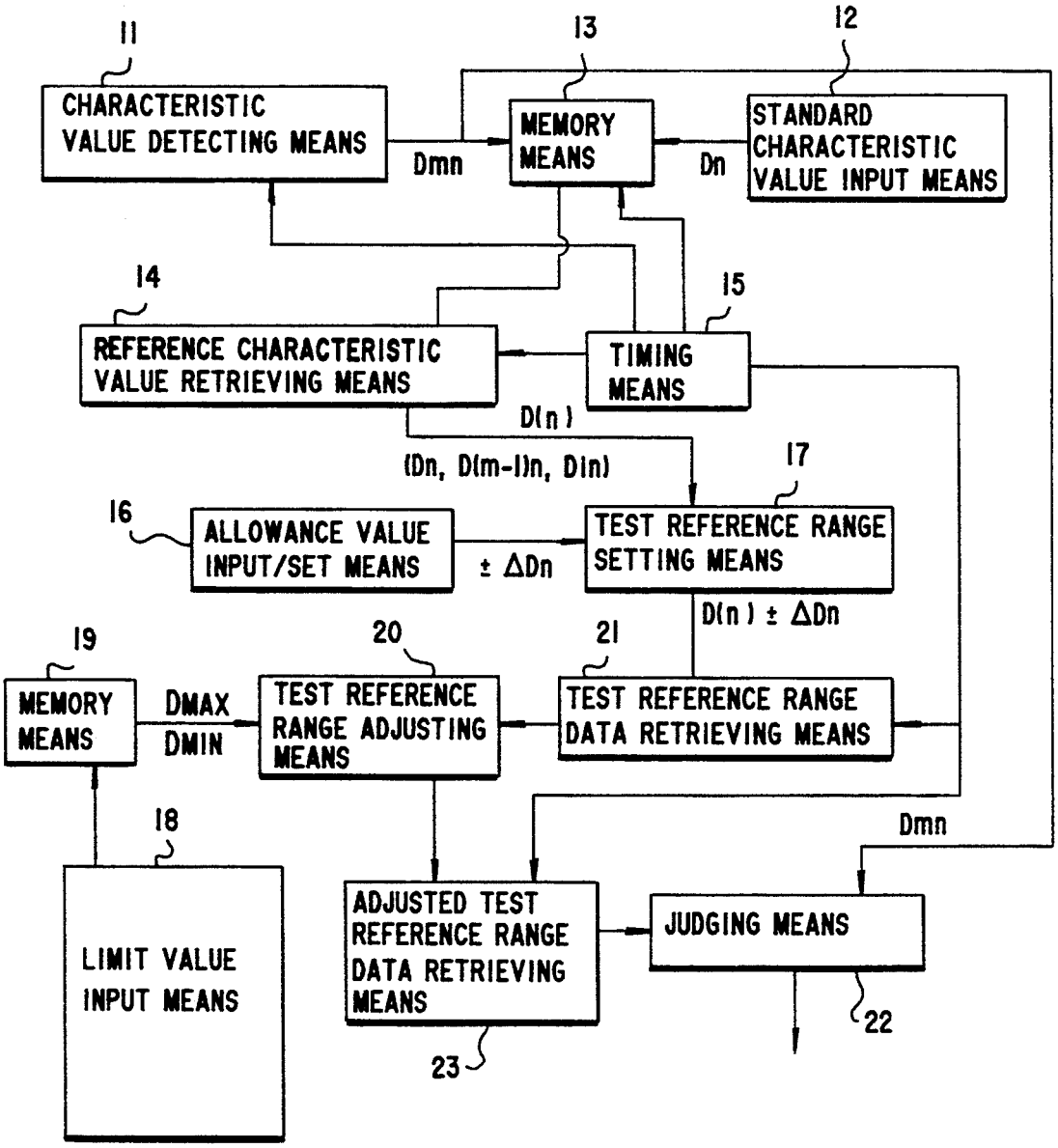
FIG. 6 is a block diagram showing one embodiment of the inventive monitor apparatus.

FIG. 6 is a block diagram showing overall structure of the inventive monitor apparatus. The apparatus is comprised of a characteristic value detecting means 11 in the form of a detector for detecting an actual characteristic value $D_{mn}$ of an article $a_{mn}$, and a standard characteristic value input means 12 for inputting a known standard characteristic value $D_n$ of an article class $A_n$. A memory means 13 is provided to memorize or store either of the detected or sampled characteristic value $D_{mn}$ and the known standard characteristic value $D_n$. A reference characteristic value retrieving means 14 is connected to the memory means 13 to retrieve therefrom a reference characteristic value D(n) in the form of the standard characteristic value $D_n$ or a precedingly sampled characteristic value $D_{(m-1)n}$ or an initialy sampled characteristic value $D_{1n}$. There is provided a timing means 15 including a timing generator for generating a sampling signal each feeding operation of an individual article and another timing generator in the form of a cam switch rotating 360° each cycle of feeding operation or a contact switch or an n-number counter for generating a cycle signal each cycle of the feeding operation in which a set of n number of sheet articles are fed sequentially. An allowance value input/set means 16 is provided to input and set a known allowance value $\Delta D_n$ for each class $A_n$ of the article. A test reference range setting means 17 is provided to calculate and determine a test reference range $D(n)\pm\Delta D_n$ in the form of either of $D_n\pm\Delta D_n$, $D_{1n}\pm\Delta D_n$ or $D_{(m-1)n}\pm\Delta D_n$, based on the inputted allowance data $\Delta D_n$ and the retrieved reference characteristic data D(n) in the form of either of $D_n$, $D_{(m-1)n}$ or $D_{1n}$. A limit value input means 18 is provided to input a maximum limit value $D_{max}$ and a minimum limit value $D_{min}$, which indicate effective upper and lower limits of detection capacity of the detector used. The limit values $D_{max}$ and $D_{min}$ are stored in another memory means 19. A test reference range adjusting means 20 is provided to compare the original test reference range data $D(n)\pm\Delta D_n$ fed from a test reference range data retrieving means 21, with the limit values $D_{max}$ and $D_{min}$ to thereby determine a selectively adjusted test reference range. Lastly, a judging means 22 is provided to comparatively examine the sampled characteristic value $D_{mn}$ by the adjusted test reference range fed from an adjusted test reference range retrieving means 23 to thereby generate either of normality signal and abnormality signal.

Figure 7A:
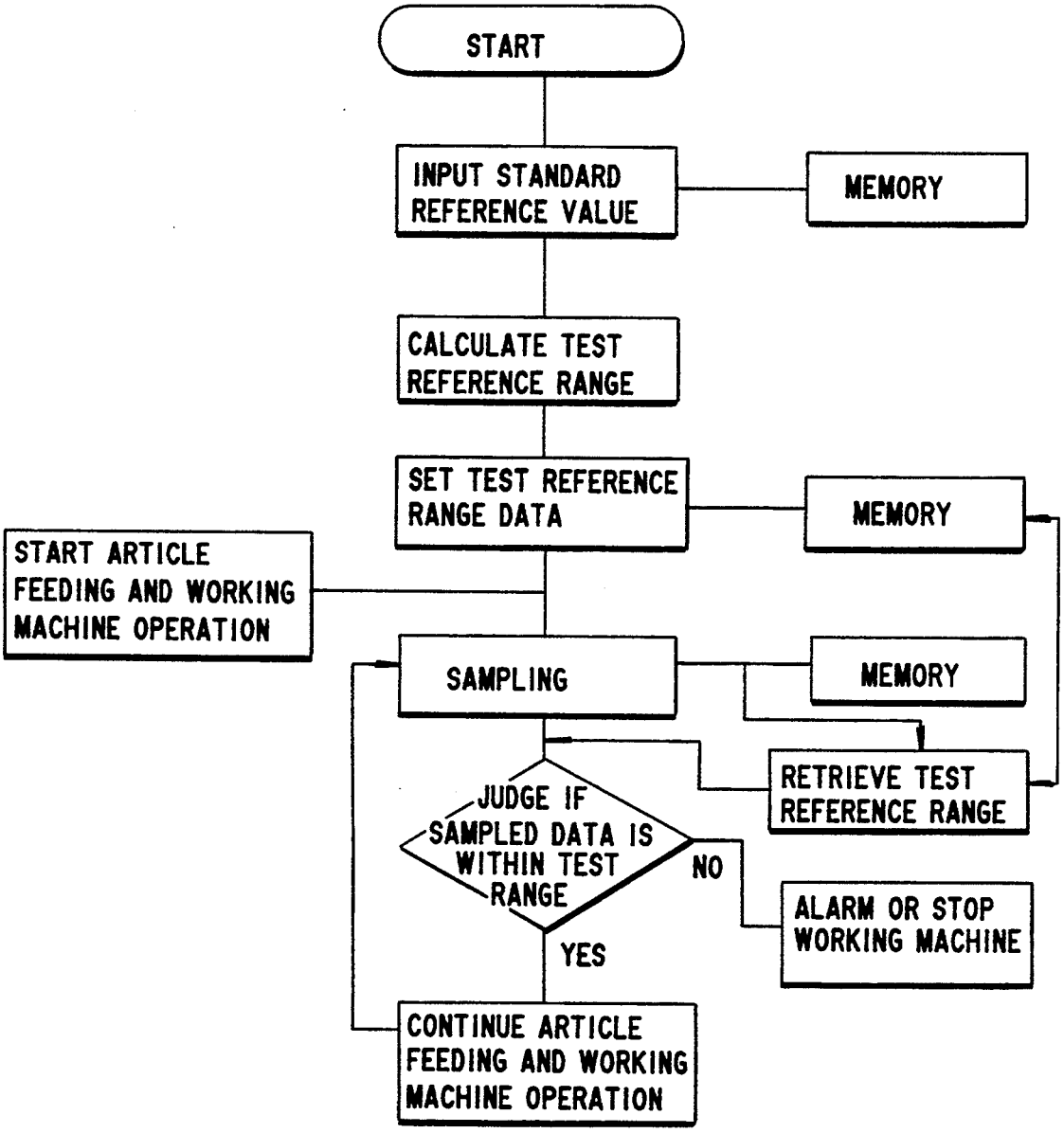
FIG. 7A is a flow chart showing an operation mode of the FIG. 6 embodiment, in which a reference characteristic value is inputted in the form of a known standard characteristic value.

FIG. 7A is a flow chart showing operation of the FIG. 6 embodiment of the inventive monitor apparatus, in which the basic test reference range is calculated according to the known standard characteristic value $D_n$ and the known allowance value $\Delta D_n$. Before the start of the feeding operation, the standard characteristic value input means 12 is operated to store in the memory means 13 the known standard characteristic value $D_n$ specific to a particular class $A_n$ of article to be transferred in order to determine a reference characteristic value. Concurrently, the allowance value input/set means 16 is operated to input and set the allowance value $\Delta D_n$. Then, the test reference range setting means 17 is operated to add the allowance $\pm\Delta D_n$ to the standard characteristic value $D_n$ or the center value of the article class $A_n$ to determine the test reference range $D_n\pm\Delta D_n$ for each of n classes of article. This test reference ranges $D_n\pm\Delta D_n$(n=1,2. . . K) are stored in a buffer memory provided in the test reference range setting means 17, according to the feeding order of the article of the different classes. Thereafter, the retrieving means 21 is operated each feeding cycle to retrieve the test reference range data from the setting means 17 according to the feeding order of the article set each feeding cycle.

In such operation, the detector is utilized to sample the actual characteristic value $D_{mn}$. The detector has its own effective maximum limit value $D_{max}$ and effective minimum limit value $D_{min}$, dependent on structural or functional variation of an individual detector. Generally, the detector has an effective maximum limit value $D_{max}$ of, e.g., 100 identical to the nominal full scale of 100 of the detector, and has an effective minimum limit value $D_{min}$ of e.g., 0 identical to the nominal zero scale. However, in some case dependent on sensitivity of a sensing element connected to a scale meter which has the nominal full scale of 100, the scale meter may indicate an effective maximum limit value of, e.g, 95 even if the sample article has an actual characteristic value in the order of scale 96 or, even more, 100. Therefore, the characteristic value is sampled incorrectly at the scale of 95. On the other hand, a certain scale meter may not indicate a scale value less than 18 even if it has a nominal minimum scale of 0. In such case, the detector has the maximum limit value $D_{max}=95$ and the effective minimum limit value $D_{min}=18$.

Erroneous judgement would be caused due to variation in sensitivity of individual detectors in case that the inventive monitor apparatus is operated such that a sampled characteristic value $D_{mn}$ is tested solely based on the basic or original test reference range, e.g., $D_n\pm\Delta D_n$ to effect judgement. The basic test reference range might be set to include and even extend beyond the maximum limit value $D_{max}$ or minimum limit value $D_{min}$.

In such case, the sampled characteristic value $D_{mn}$ would be limited to $D_{max}$ or $D_{min}$, even if an actual characteristic value falls out of the basic test reference range. Therefore, the corresponding article might be incorrectly judged as being normal as long as the basic test reference range is fixed. Therefore, according to the invention, the test reference range is adjusted according to $D_{max}$ and $D_{min}$.

According to this embodiment of the invention, the test reference range data retrieved from the setting means 17 is once inputted into the test reference range adjusting means 20. The adjusting means 20 is operated to compare the inputted test reference range data with the maximum limit value $D_{max}$ and the minimum limit value $D_{min}$ which indicate effective limits of actual capacity specific to the detector for use in detection of article characteristic value $D_{mn}$ and which are provisionally set in the memory means 19 by the limit value input means 18 and are then retrieved from the memory means 19 to the adjusting means 20. Based on the comparison results, the adjusting means 20 adjusts the original test reference range data if necessary so as to reset the test reference range to thereby avoid misjudgement. The final test reference range data is inputted into the judging means 22 to effect comparative judgement of the sampled characteristic value $D_{mn}$ with using the final test reference range data.

The adjustment of the test reference range is selectively carried out as follows: If $(D_n+\Delta D_n)_{max}<D_{max}$ and $(D_n-\Delta D)_{min}>D_{min}$, then the test reference range is set to $D_n-\Delta D_n<D_{mn}<D_n+\Delta D_n$. If $(D_n+\Delta D_n)_{max}\geqq D_{max}$ or $(D_n-\Delta D_n)_{min}\leqq D_{min}$, then the test range is reset to $D_{min}<D_{mn}<D_n+\Delta D_n$ or $D_n-\Delta D_n<D_{mn}<D_{max}$. Only when the sampled characteristic value $D_{mn}$ falls within the final test reference range, the judging means 22 produces a normality signal.

Figure 8:
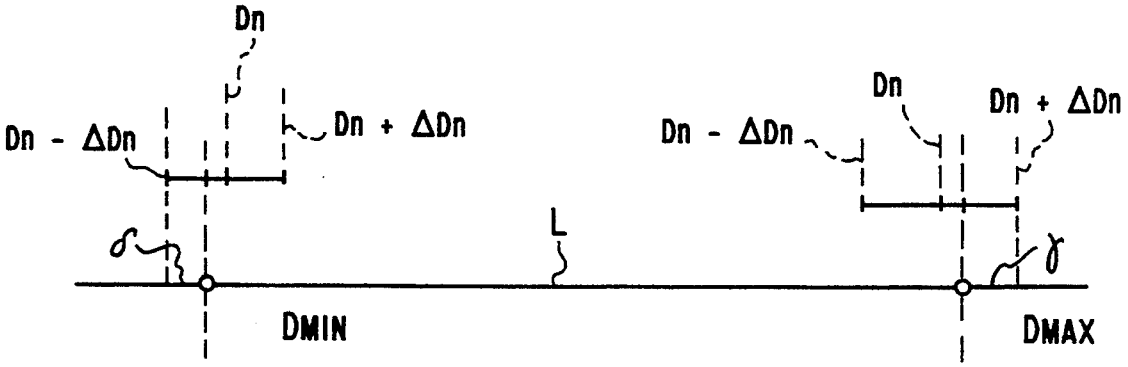
FIG. 8 is an illustrative diagram showing adjustment of test reference range in terms of variables $\delta$ and $\gamma$.

In modification, as shown in FIG. 8, if the original test reference range $D_n\pm\Delta D_n$ is less than the minimum limit value $D_{min}$ of the detector or exceeds the maximum limit value $D_{max}$, the test reference range is adjusted in taking account of a difference $\delta$ between $D_{min}$ and $D_n-\Delta D_n$ and another difference $\gamma$ between $D_{max}$ and $D_n+\Delta D_n$. These differences $\delta$ and $\gamma$ denote nondetectable range. On the other hand, a span L between $D_{min}$ and $D_{max}$ denotes the detectable range. The adjustment of the test reference range is effected as follows: If $D_{min}-(D_n-\Delta D_n)_{min}=\delta\geqq 0$, then the adjusted test range is $D_n-(\Delta D_n-\delta)<D_{mn}<D_n+(\Delta D_n-\delta)$. On the other hand, if $(D_n+\Delta D_n)_{max}-D_{max}=\gamma\geqq 0$, then the adjusted test range is $D_n-(\Delta D_n-\gamma)<D_{mn}+(\Delta D_n-\gamma)$. Only when sampled characteristic value $D_{mn}$ falls within these adjusted test reference ranges, the judging means 22 produces a normality signal. In this modification, the original test reference range is limited or cut symmetrically by the amount $\delta$ or $\gamma$ around the center value $D_n$.

As described above, the judging means 22 receives sequentially and cyclicly through the buffer memory the adjusted test reference range data according to the feeding order of articles. From the first cycle of the feeding, the retrieving means 23 operates in response to the cycle signal generated by the timing means 15 each cycle to retrieve from the buffer memory the test reference range data successively according to the feeding order of the set of articles within one cycle. The sampled characteristic value of each article is compared with the corresponding test reference range data to thereby judge as to whether or not the sampled characteristic value of each article falls within the test reference range or test window. If the sampled value is within the test window, it is judged that the article is normally transferred. On the other hand, if the sampled value is out of the test window, it is judged that the article is abnormally transferred. In this embodiment, the basic test formula is given in the form of $D_n-\Delta D_n<D_{mn}<D_n+\Delta D_n$.

In another modification of the present invention, the basic test reference range is calculated based on the precedingly sampled characteristic value $D_{(m-1)n}$ at the (m−1)-th cycle and the corresponding known allowance value $\Delta D_n$ in order to test the currently sampled characteristic value $D_{mn}$ measured on real time basis at the m-th cycle during the course of continuous feeding of articles so as to recognize normality or abnormality of the article feeding condition. In this case, the basic test reference range can be adjusted finally as follows: If $(D_{(m-1)n}+\Delta D_n)_{max}<D_{max}$ and $(D_{(m-1)n}-\Delta D_n)_{min}<D_{min}$, the final test window is set as is the original test window $D_{(m-1)n}-\Delta D_n<D_{mn}<D_{(m-1)n}+\Delta D_n$. On the other hand, if $(D_{(m-1)n}+\Delta D_n)_{max}\geqq D_{max}$ or $(D_{(m-1)n}-\Delta D_n)_{min}\geqq D_{min}$, the adjusted test window is given $D_{min}<D_{mn}<D_{(m-1)\ n}+\Delta D_n$ or $D_{(m-1)n}-\Delta D_n<D_{mn}<D_{max}$. The judging means operates only when the sampled value $D_{mn}$ falls within these test windows to produce a normality signal.

Alternatively, the adjustment of the basic test reference range is effected as follows: If $D_{min}-(D_{(m-1)n}-\Delta D_n)_{min}=\delta\geqq 0$, then the adjusted test reference range is $D_{(m-1)n}-(\Delta D_n-\delta)<D_{mn}<D_{(m-1)n}+(\Delta D_n-\delta)$. Similarly, if $(D_{(m-1)n}+\Delta D_n)_{max}-D_{max}=\gamma\geqq 0$, then the test reference range is reset to $D_{(m-1)n}-(\Delta D_n-\gamma)<D_{mn}<D_{(m-1)n}+(\Delta D_n-\gamma)$. The judging means operates only when the sampled characteristic value $D_{mn}$ falls within the above test windows for producing a normality signal.

Figure 7B:
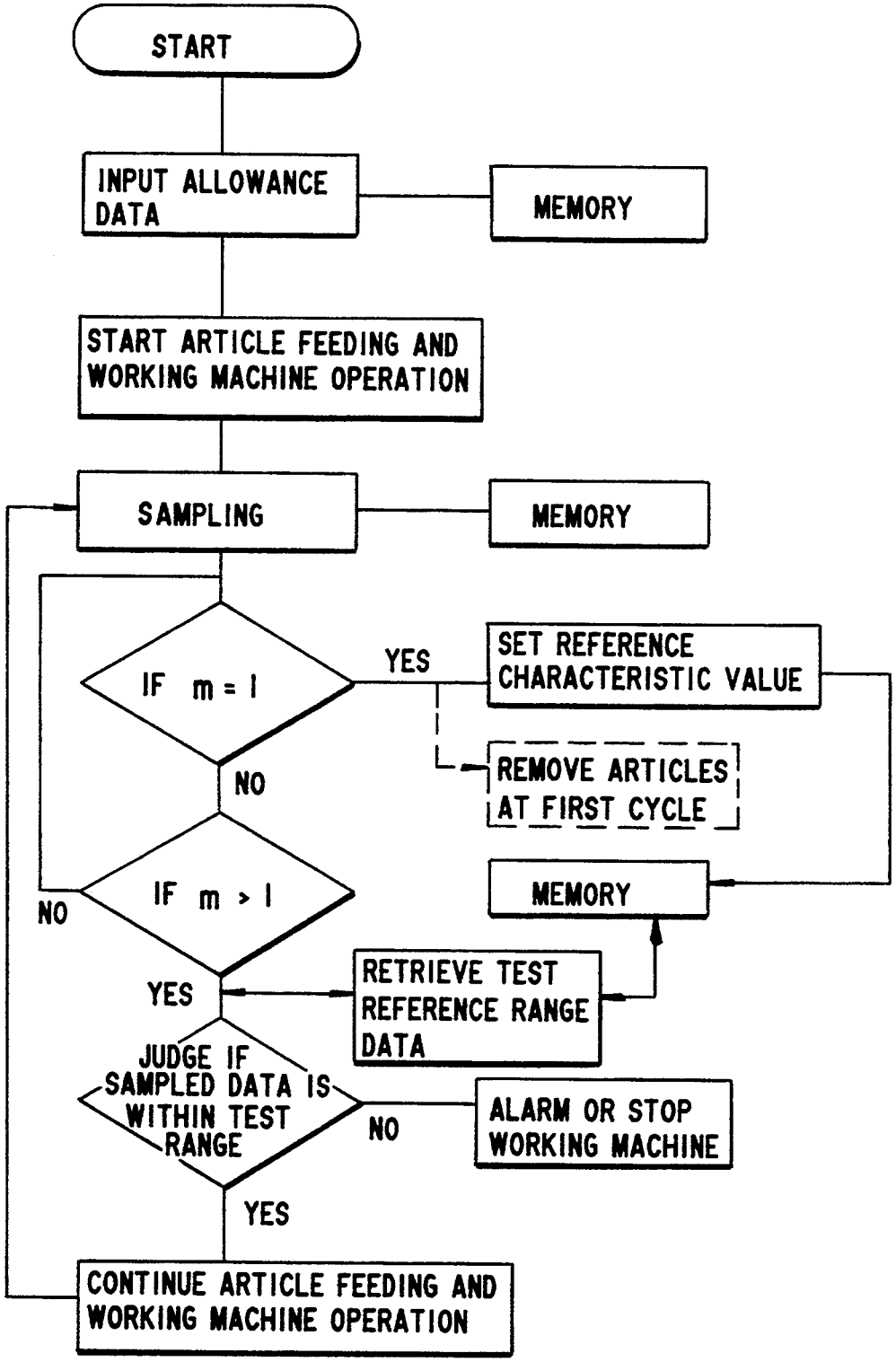
FIG. 7B is a flow chart showing an alternative operation mode of the FIG. 6 embodiment, in which a reference characteristic value is automatically set in the form of a precedingly sampled characteristic value.

FIG. 7B is a flow chart showing operation of still another modification of the inventive monitor apparatus, in which the test reference range is calculated with using an initially sampled characteristic data to monitor the following continuous feeding condition during the course of the article feeding operation. In this modification, after start of the article feeding and detecting, each of the initially sampled characteristic values $D_{1n}$ of the n classes of articles at the first cycle is utilized as a reference characteristic value or center value. The first sampled characteristic values $D_{1n}$ at the first cycle (m=1) and the corresponding allowance values $\Delta D_n$ of each class of articles to be transferred are inputted provisionally. The allowance $\pm\Delta D_n$ is added to the center value in the form of the first sampled characteristic value $D_{1n}$ to determine the test reference range $D_{1n}\pm\Delta D_n$ for the test at the second and further cycle of the article feeding. This test reference range $D_{1n}\pm\Delta D_n$ is stored or recorded in the buffer memory of the test reference range setting means in the predetermined order within one cycle.

After the orderly record of the test reference range data in the buffer memory provided in the test reference range setting means, the test reference range data is retrieved from the range setting means each cycle according to the repeated feeding order, corresponding to the transferred articles. The retrieved range data $D_{1n}\pm\Delta D_n$ is once inputted into the adjusting means. The inputted test range data is compared by the adjusting means with the known maximum limit value $D_{max}$ and the minimum limit value $D_{min}$, which are inputted by the limit value input means into the corresponding memory means and are retrieved therefrom to the adjusting means. Based on the comparison results, the adjusting means operates to adjust or limit the initialy set test reference range, if necessary, to thereby select an optimum test reference range effective to eliminate misjudgement. This selected test reference range data is inputted into the judging means to control the same.

By such operation, the automatically adjusted or selected test reference range data in the first cycle (m=1) is utilized for testing the sampled characteristic value $D_{mn}$ obtained in the second and following cycles (m=2,3,4,5,6, . . . ,j) so as to judge normal feeding or abnormal feeding. In this case, the basic test formula is represented by $D_{1n}-\Delta D_n<D_{mn}<D_{1n}+\Delta D_n$.

For summary, the invention is applied to the continuous feeding of articles of different classes having different characteristic values in terms of thickness, weight and optical density, such that a given set of different articles are cyclically fed in a predetermined sequence or order. The sequentially and continuously fed article is detected in an intermediate feeding path to measure the actual characteristic value $D_{mn}$. Then each sampled characteristic value $D_{mn}$ is compared with each corresponding test reference range data which is calculated by adding an allowance $\pm\Delta D_n$ provisionally inputted according to known quality variation specific to a particular class of articles such as JIS standard quality allowance value of the article class, around a given reference value D(n) or center value. The center value D(n) may be represented by a standard characteristic value $D_n$ of a particular article class such as JIS standard quality level value indicative of the quality or grade of the particular article class. This standard characteristic value $D_n$ is provisionally inputted prior to the article feeding to determine the test reference range $D_n\pm\Delta D_n$.

Alternatively, the center value or the reference characteristic value D(n) is given in the form of a precedingly sampled characteristic value $D_{(m-1)n}$ measured one cycle before the currently sampled corresponding characteristic value $D_{mn}$ on the real time basis, thereby determining the test reference range data of $D_{(m-1)n} \pm \Delta D_n$ which is updated each cycle. Further alternatively, the center value D(n) may be given in the form of the first sampled characteristic value $D_{1n}$ measured at the first cycle, or in the form of another sampled characteristic value measured at an early cycle from the start of operation, thereby determining the test reference range data of $D_{1n} \pm \Delta D_n$. In any case, the test formula is represented by: $D(m) - \Delta D_n < D_{mn} < D(n) + \Delta D_n$. When the sampled characteristic value $D_{mn}$ satisfies the above test formula, there is produced a normality signal indicative of normal feeding free of doubling or multipling or missing. On the other hand, when the comparison result is held $D_{mn} < D(n) - \Delta D_n$, there is produced an abnormality signal indicative of occurrence of misfeeding due to doubling or collating error, which would cause phase shift of stacking or arranging cycle of the article with respect to the cyclic and orderly retrieval of the respective test reference range data. Similarly, when the comparison result is held $D_{mn} > D(n) + \Delta D_n$, there is also generated an abnormality signal indicative of occurrence of irregular phase shift of the stacked or arranged articles due to collating error or double feeding with respect to the cyclic and orderly retrieval of the respective test reference range data.

Further, according to the specific feature of the invention, there is provided the adjusting means for adjustively selecting the test reference range dependently on whether or not the basic test reference range in the form of $D_n \pm \Delta D_n$, $D_{(m-1)n} \pm \Delta D_n$ or $D_{1n} \pm \Delta D_n$ extends beyond either of the maximum limit value $D_{max}$ and the minimum limit value $D_{min}$, which are specific to a detector for use in the measurement of the sampled characteristic value $D_{mn}$. Accordingly, if the preset basic test reference range covers more than the maximum limit value or covers less than the minimum limit value, the adjusted test reference range is selected such that an abnormality is judged when the sampled characteristic data $D_{mn}$ indicates the maximum limit value $D_{max}$ or the minimum limit value $D_{min}$.

Accordingly, there can be avoided erroneous judgement which would otherwise occur such as to misjudge that all of the articles are normally fed in order without misfeeding such as doubling when the sampled characteristic data $D_{mn}$ indicates the maximum or minimum limit value.

The inventive monitor apparatus is used when transferring or feeding a group of articles belonging to different classes having different characteristic value in terms of thickness, weight or optical density and being arranged or stacked or collated according to a given cyclic order, to a separate place continuously and sequentially according to the same cyclic order, for monitoring whether or not misfeeding such as doubling occurs. The present invention is quite effective not only in monitoring of feeding of the uniform stack of the same articles, but also in monitoring of repeated and continuous feeding of mixed stack of different articles in one line, thereby simplifying a detecting constrution of misfeeding such as doubling in the continuous feeding of the different class articles.

What is claimed is:

1. An apparatus for monitoring continuous feeding of articles which belong to different classes having different ranges of a characteristic value D(n) and which are provisionally collated according to a given order n of the classes in cyclic manner, the apparatus comprising;

means for continuous feeding of provisionally collated articles;

detecting means for sequentially detecting articles during the courses of continuous feeding of the provisionally collated articles to sample a characteristic value $D_{mn}$ of each article where m denotes a cycle number and n denotes an order in one cycle, and wherein the characteristic value of articles within at least two orders within a cycle vary;

storing means for storing a varying reference characteristic value D(n) and a corresponding allowance value $\Delta D_n$, which are specific to the particular order of the article in the class;

setting means for setting a test reference range in the form of $D(n) \pm \Delta D_n$ for each order of article;

judging means operative in the m-th cycle to compare the sampled characteristic value $D_{mn}$ with the n-th test reference range $D(n) \pm \Delta D_n$ for sequentially judging as to whether an abnormality occurs or not during the course of the continuous feeding of the articles; and abnormality indicating means for indicating an abnormality judged by said judging means, by stopping the continuous feeding of the articles.

2. An apparatus according to claim 1; wherein the storing means includes means for storing the reference characteristic value D(n) in the form of a known standard characteristic value $D_n$ specific to the class so as to determine the test reference range in the form of $D_n \pm \Delta D_n$.

3. An apparatus according to claim 1; wherein the storing means includes means for storing the reference characteristic value D(n) in the form of a sampled characteristic value $D_{(m-1)n}$ which has been detected in a preceding (m−1)-th cycle so as to determine the n-th test reference range in the form of $D_{(m-1)n} \pm \Delta D_n$ for testing the currently sampled characteristic value $D_{mn}$.

4. An apparatus according to claim 1; wherein the storing means includes means for storing the reference characteristic value D(n) in the form of an initially sampled characteristic value $D_{1n}$ which has been detected at the first cycle so as to determine the n-th test reference range in the form of $D_{1n} \pm \Delta D_n$.

5. An apparatus according to claim 1; including inputting means for inputting a particular maximum limit value $D_{max}$ and a particular minimum limit value $D_{min}$, which are indicative of effective upper and lower limits of detection capacity specific to the detecting means provided in the apparatus, and adjusting means for comparing a maximum test reference value $(D(n) + \Delta D_n)$ which is maximum among all of the test reference values with $D_{max}$ and comparing a minimum test reference value $(D(n) - \Delta D_n)$ which is minimum among all of the test reference values with $D_{min}$ so as to adjust the test reference range according to comparison results.

6. An apparatus according to claim 1; wherein the detecting means includes means for sampling a characteristic value in terms of weight, thickness or optical density of an individual article.

7. An apparatus for monitoring continuous feeding of articles which belong to different classes having different ranges of a characteristic value D(n) and which are provisionally collated according to a given order n of the classes in cyclic manner, the apparatus comprising;

means for continuous feeding of provisionally collated articles;

detecting means for sequentially detecting articles during the course of continuous feeding of the provisionally collated articles to sample a characteristic value $D_{mn}$ of each article where m denotes a cycle number and n denotes an order in one cycle, and wherein the characteristic value of articles within at least two orders within a cycle vary;

storing means for storing the varying reference characteristic value D(n) and a corresponding allowance value $\Delta D_n$ which are specific to the particular order of the article in the class;

setting means for setting a test reference range in the form of $D(n) \pm \Delta D_n$ for each order of article;

inputting means for inputting a particular maximum limit value $D_{max}$ and a particular minimum limit value $D_{min}$ which are indicative of effective upper and lower limits of detection capacity specific to the detecting means provided in the apparatus, and adjusting means for comparing a maximum test reference value $(D(n)+\Delta D_n)$ which is maximum among all of the test reference values with $D_{max}$ and comparing a minimum test reference value $(D(n)-\Delta D_n)$ which is minimum among all of the test reference values with $D_{min}$ so as to adjust the test reference range according to comparison results;

wherein the adjusting means includes means for adjusting the test reference range as follows:

if $(D(n)+\Delta D_n)<D_{max}$ and $(D(n)-\Delta D_n)>D_{min}$; then the adjusted test reference range is: $D(n)-\Delta D_n<D_{mn}<D(n)+\Delta D_n$; and if $(D(n)+\Delta D_n)\geqq D_{max}$ or $(D(n)-\Delta D_n)\leqq D_{min}$, then the adjusted test reference range is: $D_{min}<D_{mn}<D(n)+\Delta D_n$ or $D(n)-\Delta D_n<D_{mn}<D_{max}$;

judging means operative in the m-th cycle to compare the sampled characteristic value $D_{mn}$ with the n-th test reference range adjusted by the adjusting means for sequentially judging as to whether an abnormality occurs or not during the course of the continuous feeding of the articles; and abnormality indicating means for indicating an abnormality judged by said judging means, by stopping the continuous feeding of the articles.

8. An apparatus for monitoring continuous feeding of articles which belong to different classes having different ranges of a characteristic value D(n) and which are provisionally collated according to a given order n of the classes in cyclic manner, the apparatus comprising;

means for continuous feeding of provisionally collated articles;

detecting means for sequentially detecting articles during the course of continuous feeding of the provisionally collated articles to sample a characteristic value $D_{mn}$ of each article where m denotes a cycle number and n denotes an order in one cycle, and wherein the characteristic value of articles within at least two orders within a cycle vary;

storing means for storing the varying reference characteristic value D(n) and a corresponding allowance value $\Delta D_n$, which are specific to the particular order of the article in the class;

setting means for setting a test reference range in the form of $D(n) \pm \Delta D_n$ for each order of article;

inputting means for inputting a particular maximum limit value $D_{max}$ and a particular minimum limit value $D_{min}$ which are indicative of effective upper and lower limits of detection capacity specific to the detecting means provided in the apparatus, and adjusting means for comparing a maximum test reference value $(D(n)+\Delta D_n)$ which is maximum among all of the test reference values with $D_{max}$ and comparing a minimum test reference value $(D(n)-\Delta D_n)$ which is minimum among all of the test reference values with $D_{min}$ so as to adjust the test references range according to comparison results;

wherein the adjusting means includes means for adjusting the test reference range as follows:

if $D_{min}-(D(n)-\Delta D_n)=\delta\geqq 0$, then the adjusted test reference range is: $D(n)-(\Delta D_n-\delta)<D_{mn}<D(n)+(\Delta D_n-\delta)$; and if $(D(n)+\Delta D_n)-D_{max}=\gamma\geqq 0$, then the adjusted test reference range is: $D(n)-(\Delta D_n-\gamma)<D_{mn}<D(n)+(\Delta D_n-\gamma)$, where $\delta$ and $\gamma$ are ranges nondetectable by said detecting means;

judging means operative in the m-th cycle to compare the sampled characteristic value $D_{mn}$ with the n-th test reference range adjusted by the adjusting means for sequentially judging as to whether an abnormality occurs or not during the course of the continuous feeding of the articles; and abnormality indicating means for indicating an abnormality judged by said judging means, by stopping the continuous feeding of the articles.

* * * * *